United States Patent [19]

Bryant et al.

[11] Patent Number: 4,537,050

[45] Date of Patent: Aug. 27, 1985

[54] METHOD OF CONTROLLING A STAND FOR ROLLING STRIP MATERIAL

[75] Inventors: Greyham F. Bryant, Southall; Peter D. Spooner, Middlesex; William K. J. Pearson, Amersham, all of England

[73] Assignee: The British Aluminium Company plc, London, England

[21] Appl. No.: 669,445

[22] Filed: Nov. 8, 1984

Related U.S. Application Data

[63] Continuation of Ser. No. 453,860, Dec. 20, 1982, abandoned.

[30] Foreign Application Priority Data

Apr. 25, 1981 [GB] United Kingdom ..... 8112816
Apr. 23, 1982 [WO] PCT Int'l Appl. ... PCT/GB82/00120

[51] Int. Cl.[3] ..... B21B 37/06; B21B 37/12; B21B 27/06

[52] U.S. Cl. ..... 72/8; 72/12; 72/34; 72/201; 72/243

[58] Field of Search ..... 72/8, 10, 11, 12, 17, 72/34, 200, 201, 202, 236, 243, 245

[56] References Cited

U.S. PATENT DOCUMENTS

| | | | |
|---|---|---|---|
| 1,380,250 | 5/1921 | Reymond | 72/342 |
| 3,518,858 | 7/1970 | Kamata | 72/243 |
| 3,802,237 | 4/1974 | Albensi | 72/34 |
| 4,262,511 | 4/1981 | Basvert | 72/34 |

FOREIGN PATENT DOCUMENTS

| | | |
|---|---|---|
| 899532 | 6/1962 | United Kingdom . |
| 1160112 | 7/1969 | United Kingdom . |
| 1587420 | 4/1981 | United Kingdom . |
| 2012198 | 7/1979 | United Kingdom . |
| 2017974 | 10/1979 | United Kingdom . |

*Primary Examiner*—E. Michael Combs
*Attorney, Agent, or Firm*—Karl W. Flocks; Sheridan Neimark

[57] ABSTRACT

A method of controlling one stand of a mill for rolling strip material, the mill having upper and lower back-up rolls and a pair of work rolls disposed between the back-up rolls, first and second screw means for respectively controlling movement of the ends of one of the back-up rolls and first and second jack means for respectively applying forces to each of the ends of the work rolls and a shape sensor having outputs from which the stress distribution across the width of the rolled strip is determined, comprising analyzing the effect upon the shape of the strip of the operation of the screw means and the jack means and deriving mathematical expressions, each including a control parameter, respectively representative of such operations determining the difference between said stress distribution and a desired stress distribution and obtaining a correction of stress distribution characterized by separately analyzing the effect upon the shape of the strip of the operation of each screw means and each jack means and deriving four mathematical expressions each including a control parameter respectively representative of such operations, determining a single error distribution E (x) as the difference between said stress distribution and a desired stress distribution, obtaining a single correction of stress distribution C (x) by determining an optimum value for each of said control parameters such that a functional of the distribution E (x)−C (x) is minimized and separately controlling each of said screws and jacks in accordance with said control parameters.

12 Claims, 4 Drawing Figures

METHOD OF CONTROLLING A STAND FOR ROLLING STRIP MATERIAL

FIELD OF THE INVENTION

This is a continuation of application Ser. No. 453,860 filed Dec. 20, 1982, abandoned.

This invention relates to a method of controlling a single stand mill or one stand of a multi-stand mill for rolling plate, sheet, foil or strip material hereinafter referred to as strip.

DESCRIPTION OF THE PRIOR ART

Metal strip rolling mills commonly have in each stand a pair of work rolls mounted between upper and lower back-up rolls one of the back-up rolls usually being mounted for rotation about a fixed axis and the other back-up roll and the work rolls having their axis movable both relative to each other and to the fixed axis. Movement of said other back-up roll axis is conventionally used to set the work roll gap or pressure and to tilt the rolls and is controlled by mechanism effectively acting at each end of the rolls and usually referred to as "screws" irrespective of the precise nature of such mechanism. Forces applied to the work rolls are conventionally used to bend the rolls and are commonly controlled by mechanisms at each end of each roll usually referred to as "jacks" again irrespective of the precise nature of the mechanisms. The jacks act respectively between the lower back-up roll and the lower work roll and the upper back-up roll and the upper work roll and additional jacks may be provided to act respectively between the work rolls and between the back-up rolls while the screws act between the movable one of the back-up rolls and a framework of the mill. Both screws and jacks may be hydraulically powered devices.

Rolled metal strip generally has residual stress variations particularly in a direction transverse to the rolling direction. These variations occur as a result of the difference which tends to exist between the transverse thickness profile of the strip fed to the mill and that of the strip leaving the mill. This transverse stress distribution in the rolled strip is called "shape" and may be unrelated to thickness variations in the strip.

A shape sensor may be used for determining the shape of rolled strip and for providing a multiplicity of output signals collectively representing shape by separately measuring the average stress across segments of the strip width. Such a shape sensor may, for example, be a shapemeter as disclosed in our earlier U.K. patent specification No. 899532 or 1160112. The signals can be used as a basis for controlling shape, primarily by operation of the screws and jacks and secondarily by modifying the thermal profile of the rolls. This may be achieved by a heat exchange device and may include induction heating or sprays for gaseous or liquid coolant. The coolant may also act as a lubricant. It will be understood that the primary control acts faster than the secondary control. Proposals have been made to provide automatic adjustment of the screws and jacks in response to the output signals of such a sensing device. The commonest proposals have required the output signals from the shape sensor to be parameterised into a first component representative of a symmetrical deviation from a desired shape and a second component representative of an asymmetrical deviation from the desired shape. It is known that symmetrical stress distribution (to be corrected by bending) can be approximated mathematically in parabolic form and that asymmetric stress distributions (to be corrected by tilting) can be approximated mathematically by a flattened -S- shaped curve.

Previous schemes have therefore grouped the controls available into three modes of correction. Typically the jacks have been operated equally in the same sense in order to bend the rolls and produce symmetrical shape corrections; the screws have been operated equally but in opposite senses to produce asymmetrical shape corrections and sprays have been used to reduce the remaining shape errors. The published specification of British patent application No. 2017974A (Loewy-Robertson Engineering Company Limited) discloses a method of controlling one stand of a mill for rolling strip material, the mill having upper and lower back-up rolls and a pair of work rolls disposed between the back-up rolls, first and second screw means to be operated equally in the same sense for respectively controlling movement of the ends of one of the back-up rolls and first and second jack means to be operated equally in opposite senses for respectively applying forces to each of the ends of the work rolls and a shape sensor having outputs from which the stress distribution across the width of the rolled strip is determined. The effect upon the shape of the strip of the operation of the screw means is analysed and a first approximate empirical mathematical expression, including a control parameter, for asymmetrical correction is derived from the particular mill to be controlled. The effect upon the shape of the strip of the operation of the jack means is also analysed and a second approximate empirical mathematical expression, including a control parameter, for symmetrical correction is derived from the particular mill to be controlled. Two values of stress distribution error representative of bending by operation of the jacks and tilting by operation of the screws are then experimentally derived and compared with desired values. The jacks are then operated together in accordance with their control parameter and stress distribution error to provide bending correction and the screws are then operated together but in opposite senses and independently of the jacks in accordance with their control parameter and stress distribution error to provide tilting correction. The production of mathematical models for the derivation of the correction expressions for a method such as that of GB-A-2017974 was disclosed in papers entitled "Analysis of shape and discussion of problems of scheduling set-up and shape control" by P. D. Spooner and G. F. Bryant and "Design and development of a shape control system" by C. A. Bravington, D. C. Barry and C. H. McClure both given at the Metals Society Conference on shape control at Chester, England on Apr. 1st, 1976 and both published on Mar. 9th, 1977.

Inherently by using corrections based upon symmetrical and asymmetrical deviation the degree of shape control is limited. Thus a larger than desirable error remains for secondary correction by roll profile modification for example with coolant sprays.

It is an object of the present invention to provide an improved method of controlling one stand of a mill for rolling metal strip in which deviation in strip shape is more accurately corrected than has hitherto been possible and so as to leave less error for secondary correction and hence produce quicker and possibly wider ranging control.

A further object is to provide an improved method of secondary correction.

Yet another object is to enable shape control to be achieved without interacting with gauge if desired.

SUMMARY OF THE INVENTION

According to the present invention there is provided a method of controlling one stand of a mill for rolling strip material, the mill having upper and lower back-up rolls and a pair of work rolls disposed between the back-up rolls, first and second screw means for respectively controlling movement of the ends of one of the back-up rolls and first and second jack means for respectively applying forces to each of the ends of the work rolls and a shape sensor having outputs from which the stress distribution across the width of the rolled strip is determined, comprising determining the effect upon the shape of the strip of the joint operation of the screw means and the joint operation of the jack means and deriving two mathematical expressions, respectively, representative of such operations, determining the difference between said stress distribution and a desired stress distribution and obtaining a correction of stress distribution characterised by separately determining the effect upon the shape of the strip of the operation of each screw means and each jack means and deriving four mathematical expressions, each including a control parameter respectively representative of such operations, determining a single error distribution E (x) as the difference between said stress distribution and a desired stress distribution, obtaining a single correction of stress distribution C (x) by determining an optimum value for each of said control parameters such that a function of the distribution E (x)−C (x) is minimised and separately controlling each of said screws and jacks in accordance with said control parameters. Preferably the distribution C (x) is obtained so that the expression E (x)−C (x) is minimised without affecting strip thickness at some predetermined position across the strip width so as to ensure non-interaction between the shape control and any guage control mechanism associated with the mill stand. The predetermined position may be the centre line of the strip. Alternatively C (x) may be determined so that the strip thickness at a predetermined position across the strip width is altered as may be desired.

Preferably the stress distribution left in the strip after applying primary stress correction control to the screws and jacks is further reduced by separately modifying the thermal profile of the rolls in a multiplicity of zones disposed along the roll and respectively corresponding to selected output channels or groups of output channels of the shape sensor the modification in each zone extending over a predetermined area of the rolls comprising calculating an influence factor for each zone depending upon the extent and magnitude of the influence of the modifications of each zone on the predetermined areas associated with adjoining zones, effecting said modification of selected zones corresponding with those channels of the shape sensor the output of which represents uncorrected stress in the strip the magnitude and sense of the modification in selected zones being subject to said influence factor to vary thermal profile of the rolls in the sense to minimise said remaining stress distribution. Preferably said modification is by coolant sprays and the flow of coolant in each spray zone is varied to minimise in a Least Squares sense the distribution E (x)−D (x) where D (x) is formed by adding the effects of the influence functions from individual zones.

DESCRIPTION OF THE DRAWINGS

The invention will now be described by way of example with reference to the accompanying drawings in which:

Referring to FIG. 1 a mill stand indicated generally at 1 has a pair of work rolls 2 and 3 and a pair of upper and lower back-up rolls 4 and 5 respectively bearing against the work rolls 2 and 3. The rolls are shown disposed vertically and it will be assumed that the lower back-up roll 5 has its ends 6 and 7 carried in fixed bearings (not shown) supported on a fixed base (not shown). Left and right screw means L8 and R8 act respectively between the movable ends 9 and 10 of the back-up roll 4 and parts 11 and 12 of a fixed framework of the mill 1. Left jack means LJ13 act respectively between the ends 9 and 6 of the back-up rolls and the ends 14 and 15 of the work rolls 2 and 3 while left jack means LJ16 act between the work roll ends 14 and 15. Similarly right jack means RJ13 act respectively between the ends 10 and 7 of the back-up rolls and the ends 17 and 18 of the work rolls 2 and 3 and right jack means RJ16 act between the work roll ends 17 and 18.

Figure 1:
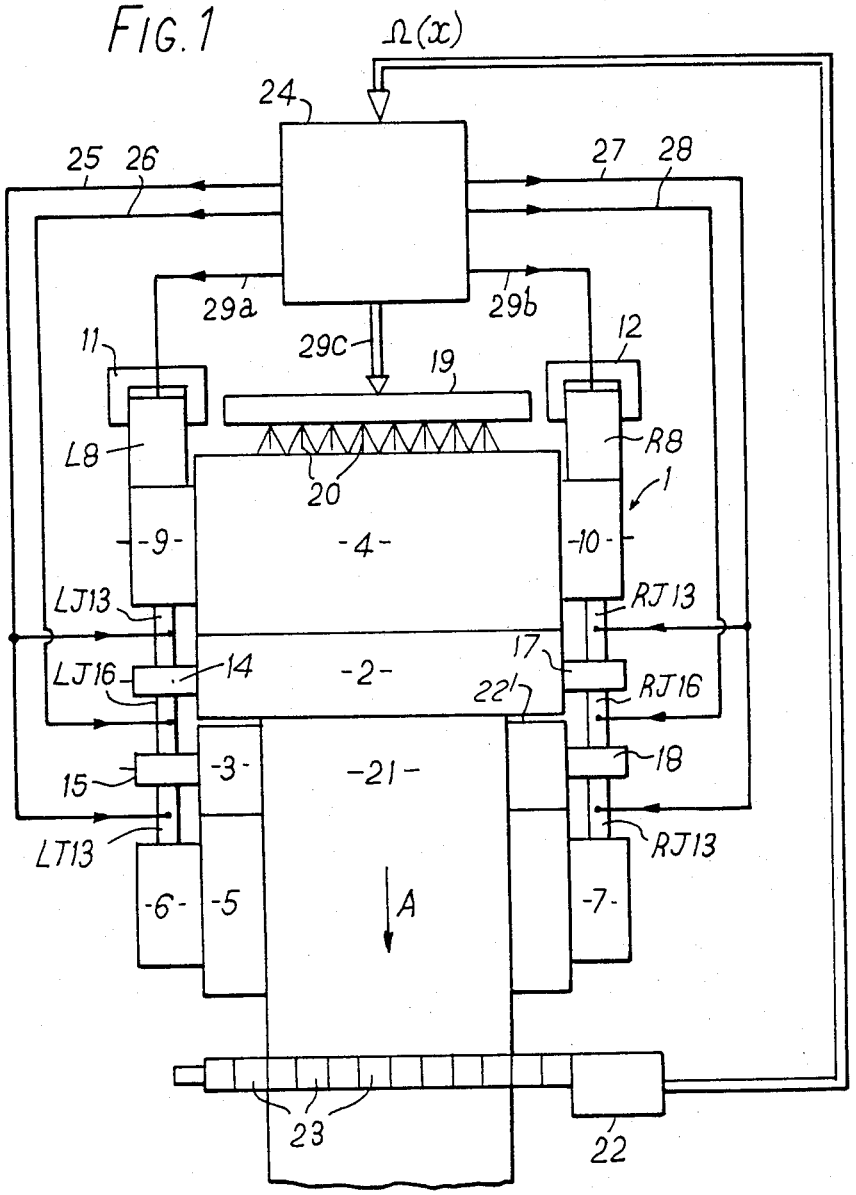
FIG. 1 shows diagrammatically a mill set and incorporating a conventional control system for screws, jacks and sprays.

A spray bar such as 19 having sprays 20 for dispensing coolant is shown, for convenience, associated with the back-up roll 4 but it will be understood that the bar 19, or a number of such bars may conventionally be associated with selected ones or all of the mill rolls.

A rolled strip 21 is shown passing from the nip 22' of the work rolls 2 and 3 in the direction of the arrow —A— and a shape sensor 22 which may be a "shapemeter" according to our earlier U.K. Pat. No. 1160112 has n rotors 23 distributed across the strip 21 to provide a multiplicity of output signals representing stress at different positions across the width of the rolled strip and collectively representing the shape Ω(x) of the rolled strip.

A control processor 24 receives the output Ω(x) and provides control signals over lines 25 and 26 to the left jack means, over lines 27 and 28 to the right jack means over lines **29*a* and 29*b* to the left and right screw means L8 and R8 over a line 29*c* to the spray bar 19**.

The arrangement so far described is conventional and in the past the control signals applied to the left and right jack means have been identical and in the same sense so that work rolls 2 and 3 are symmetrically bent to control symmetrical deviations from a desired shape of the strip 21 while the control signals applied to the left and right screw means have been identical but in opposite senses in order to tilt the roll to control asymmetrical deviations from a desired shape of the strip 21.

In the present invention control signals are applied independently to each screw means and each jack means in the sense to correct those components of shape distribution separately affected by each means. FIG. 2 shows a typical set of curves showing the relative effects of adjustment of individual screws and jacks with shape Ω being plotted against strip width x. In considering FIG. 2 and subsequently in this specification the individual jacks LJ13 and LJ16 of FIG. 1 will be collectively considered as left jack means $J_1$ and the individual jacks RJ13 and RJ16 of FIG. 1 will be collectively considered as right jack means $J_2$. Similarly the left and right screw means L8 and R8 of FIG. 1 together with any additional left and right screw means (not shown) that may be provided will collectively be referred to as $S_1$ and $S_2$.

The curves 30 and 31 respectively represent the changes of strip shape that can be obtained by independent adjustment of the left and right jack means $J_1$ and $J_2$. Similarly the curves 32 and 33 respectively represent the changes of strip shape that can be obtained by independent adjustment of the left and right screw means $S_1$ and $S_2$. Curves such as 30 to 33 can be obtained with precision by using accurate mathematical models related to a particular mill and a particular range of strip dimensions.

The curve 34 represents the sum of the curves 30 and 31 while the curve 35 represents the sum of the curves 32 and 33. The curve 36 represents the difference of the curves 30 and 31 while the curve 37 represents the difference of the curves 32 and 33.

Figure 2:
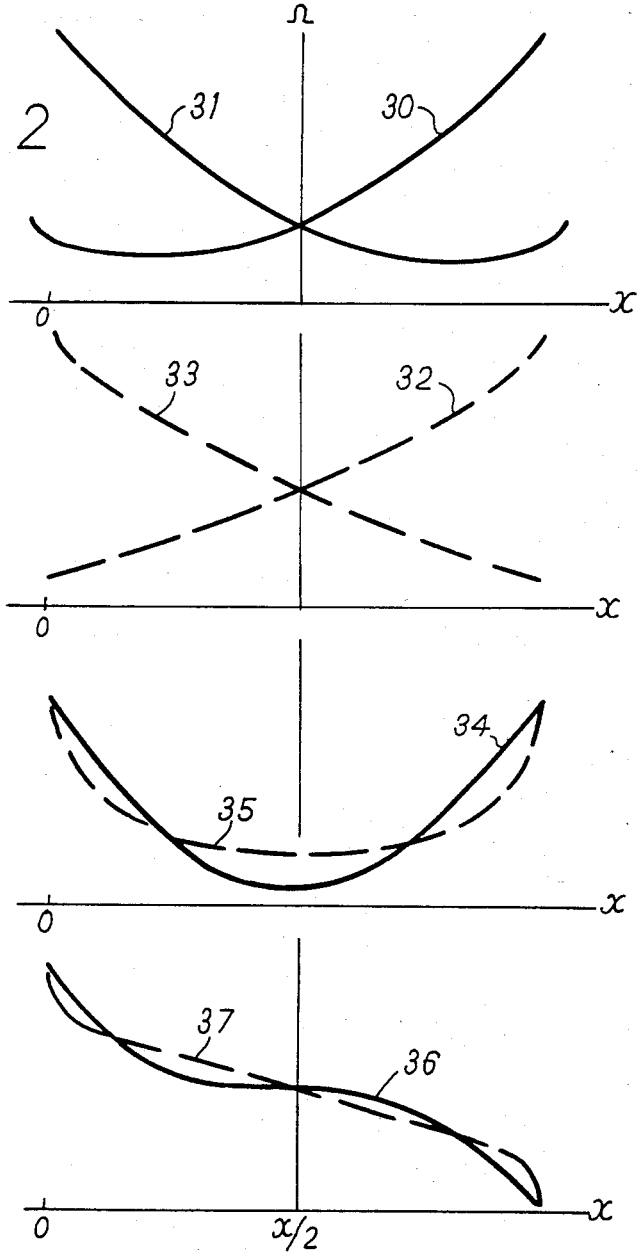
FIG. 2 is a series of graphs showing the effect of screw/jack corrections over the width of the rolled strip.

In effect the curve 34 illustrates the kind of symmetrical control previously attempted with mill control apparatus of the type shown in FIG. 1. The curve 37 similarly shows the kind of asymmetric control previously attempted by the equal operation in opposite senses of screw means alone in order to tilt the rolls. If one considers a shape error of the form of the curve 30 then clearly it can be corrected by changing the jack control signal on one side of the mill only. However, we believe it will never be possible to correct such an error exactly by using a combination of symmetric jack control and asymmetric screw control as has been attempted previously.

Figure 3:
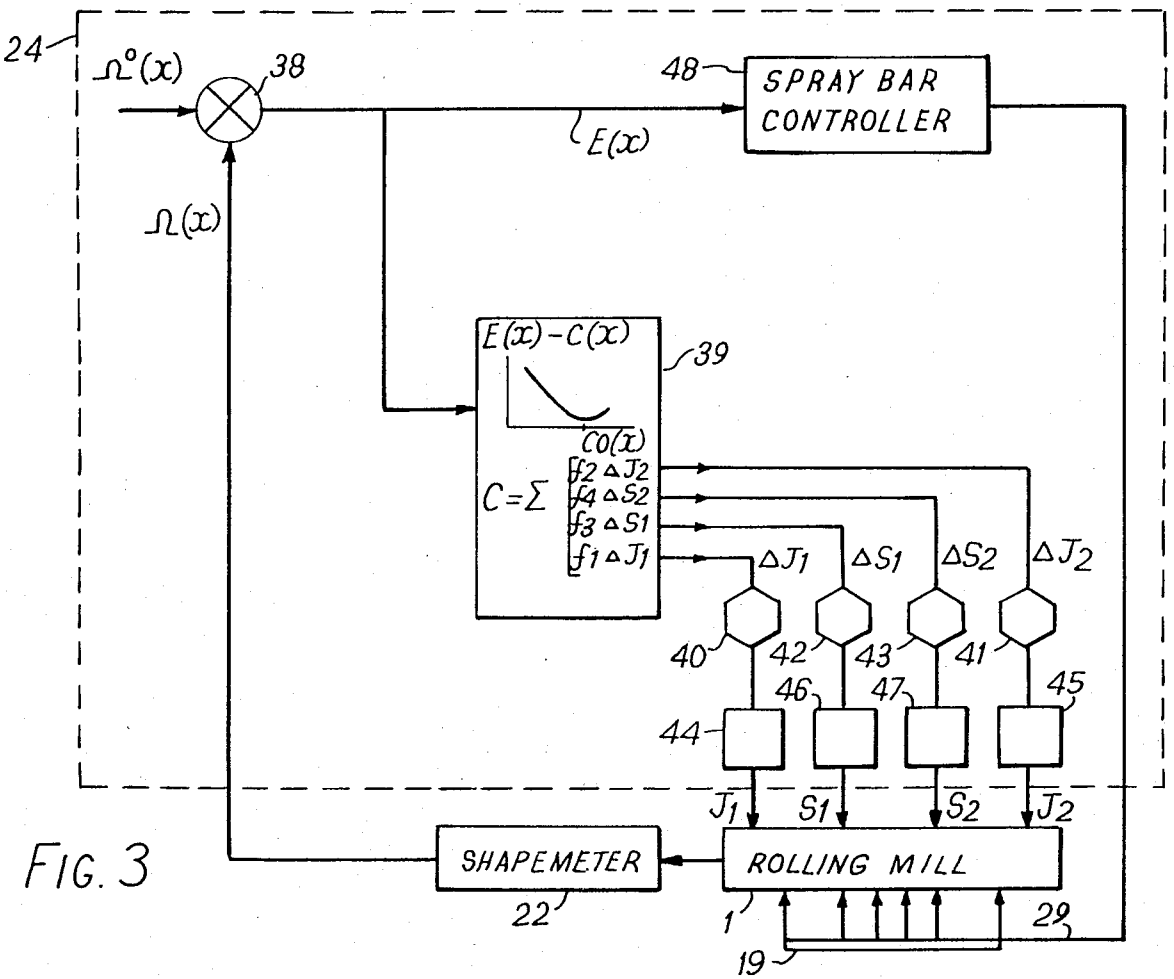
FIG. 3 is a block diagram illustrating the control system of the present invention and FIG. 4 is a graph showing the influence distribution of spray from one zone on adjoining zones.

It is fundamental to the present invention that the jack means $J_1$ and $J_2$ and the screw means $S_1$ and $S_2$ are separately and independently operated to apply shape corrections to the strip. FIG. 3 shows diagrammatically one form of the process controller 24 of FIG. 1 to enable the mill 1 to be controlled according to the present invention. This process controller has a first (and fast operating) control loop including a comparator 38 which produces an error signal E (x) representing the difference between a desired strip shape Ω°(x) and the output Ω(x) from the shapemeter 22; a computer 39; a series of schedule dependent gains 40, 41, 42 and 43; and a series of controllers 44, 45, 46 and 47 for the left and right jack means $J_1$ and $J_2$ and the left and right screw means $S_1$ and $S_2$. Th process controller 24 also has a second (and slow operating) control loop including a spray bar controller 48.

Considering FIG. 3 it will be understood that the components of shape distribution that may be modified by the individual jack means $J_1$ and $J_2$ and the screw means $S_1$ and $S_2$ may be expressed by the functions $$f_{\frac{1}{2}}(x,W,L,\Delta J_{\frac{1}{2}})$$

and $$f_{\frac{3}{4}}(x,W,L,\Delta S_{\frac{1}{2}})$$

where $f_{\frac{1}{2}}$ are respectively the changes in shape distribution caused by unit changes in the left jack means $J_1$ and the right jack means $J_2$ $f_{\frac{3}{4}}$ are respectively the changes in shape distribution caused by unit changes in the left screw means $S_1$ and the right screw means $S_2$ x is the distance across the strip from one edge W is the strip width L is the roll length $\Delta J_{\frac{1}{2}}$ are respectively control parameters representing changes in the forces applied to the left/right jack means and $\Delta S_{\frac{1}{2}}$ are respectively control parameters representing changes in the forces applied to the left/right screw means The four functions f are all dependent on mill dimensions and are preferably derived from full mathematical models although they could be approximated empirically.

By using selected combinations of different magnitudes of the jack changes $\Delta J_1$, $\Delta J_2$ and the screw changes $\Delta S_1$, $\Delta S_2$ a large range of deviations of shape distribution from the desired distribution can be corrected. In addition to causing changes in shape distributions the control exercised by the jack changes $\Delta J_1$, $\Delta J_2$ and the screw changes $\Delta S_1$, $\Delta S_2$ will also affect the output thickness of the strip (usually measured at the strip centre line $\chi/2$ in FIG. 2). Thus particular combinations of the magnitudes of the four changes $\Delta J_1$, $\Delta J_2$, $\Delta S_1$, $\Delta S_2$ can also be chosen which will result in no change in the thickness of the strip at its centre line (or at any other selected position across its width).

If, as described above Ω(x) represents the output from the shapemeter 22, (i.e.) is the measured shape distribution of the strip and Ω°(x) is the desired shape distribution then the error distribution E (x) is the difference between them. In the conventional way this error distribution forms the basic input to the process controller 24.

The four functions $f_1$, $f_2$, $f_3$ and $f_4$ are stored in the computer 39 and the latter is programmed to determine the values of $\Delta J_1$, $\Delta J_2$, $\Delta S_1$ and $\Delta S_2$ so that the resulting function C (x) minimises a functional of the distribution E (x)−C (x) (for example by Least Squares) if desired without changing the thickness of the strip at any specified position across its width. The value of C is derived from an optimum combination of the four functions f thus $$C=\Sigma[f_1(\Delta J_1)+f_2(\Delta J_2)+f_3(\Delta S_1)+f_4(\Delta S_2)]$$

so that the optimum individual values for the corrections $\Delta J_1$, $\Delta J_2$, $\Delta S_1$ and $\Delta S_2$ are applied to the jack means $J_1$, $J_2$ and the screw means $S_1$, $S_2$.

The output signals $\Delta J_1$, $\Delta J_2$, $\Delta S_1$ and $\Delta S_2$ are supplied to the jacks and screws through gains 40 to 43 and controlling 44 to 47. The gains are preferably derived from mathematical models and the controllers are designed to take account of the dynamics present in the actuators and the rolling process.

To facilitate an understanding of the above description in relation to FIG. 3 the following information relating to the derivation of a shape control algorithm is provided. The effect of the four controls $J_1$, $J_2$, $S_1$ and $S_2$ on the shape distribution in the strip can be described by an n×4 matrix A, where each of the 4 columns contains the change in the shape distribution which would be detected at each of the 'n' shapemeter rotors by a unit change in the controls collectively referred to, above, as $f_{1/2/3/4}$. Let y be the vector of the desired amplitudes of the control actions required to correct a measured shape error, then $$y = \begin{bmatrix} \Delta J_1 \\ \Delta J_2 \\ \Delta S_1 \\ \Delta S_2 \end{bmatrix}$$

and let E be the vector of shape errors obtained from the shapemeter (one per rotor) as defined above. Then if no constraints are applied to the magnitudes of the 4 controls to be used, and if the effects of these controls on strip thickness is ignored, the best control action to minimise the shape error in a least squares sense can be obtained from the solution of:

$$y=(A^TA)^{-1}A^TE$$

where A and E are defined above, $A^T$ is the transpose of A and $A^{-1}$ is the inverse of A.

Computing the inverse of the matrix can be difficult due to possible ill conditioning and to overcome this and make the algorithm robust it is recommended that an orthogonal transformation, such as the Householder Transformation, is used to transform the problem into one in which the A matrix assumes an upper triangular form.

In practice the changes demanded in the four controls must be chosen so that either, a measured thickness error is also corrected, or, if there is an independent thickness controller in operation, no disturbance is caused to the thickness. The total change in thickness caused by the action of the four controls can be expressed as $$\Delta h=G^Ty$$

where Δh is the change in thickness at some specified point across the width $G^T$ is the transpose of the vector G which contains the sensitivities of the thickness (at the specified position across the width) to each of the controls.

y is the vector of the four control amplitudes.

In the case where a separate thickness controller is in operation, the controls must be chosen so that, $$G^Ty=0$$

This constraint can be included into the unconstrained solution by the method of Lagrange multipliers so that the solution giving the controls to be applied to correct the shape without affecting the thickness can be obtained from:

$$y=(A^TA)^{-1}A^TE-(A^TA)^{-1}G\lambda$$

where λ is the Lagrange multiplier, and y is the vector of the amplitudes of the four controls which will minimise the measured shape distribution (vector E) without causing any change to the thickness defined at some point across the width. As with the unconstrained solution, the algorithm used to compute the above solution can be made more stable and efficient by using an orthogonal transformation.

In practice the four controls each have limited range and if any go into saturation the solution must be modified to take this into account. These control constraints can be included into the solution in the same way as the thickness constraint by using Lagrange multipliers. However, since if a control saturates it is no longer available (in one direction) an alternative procedure would be to delete the appropriate column of the A matrix corresponding to the saturated control (or controls) and recompute the solution as above. The deletion is maintained until the unconstrained solution is away from the saturation constraint.

The implementation of the control algorithm can be simplified since the A matrix and the G vector are effectively constant for any particular product on a mill. A and G together with their constrained forms can therefore be calculated once per coil making on-line computation very simple.

When each jack means and each screw means have been individually adjusted to minimise the shape error there will still be a remaining error to be further reduced by secondary correction, for example, by the action of lubricant and generally coolant, sprays applied to the rolls of the mill and/or the strip. This remaining error will, however, be significantly smaller than would be the case if the jack and screw corrections had been based upon the previously proposed symmetrical and asymmetrical components of the shapemeter output.

A number of spray bars 19 are usually provided to dispense coolant through nozzles which may have a 1:1 correspondence with individual output channels of the shapemeter 22 although these nozzles may be arranged in groups for easier control.

In the past the extent of secondary shape control exercised by sprays has tended to be limited to choosing the temperature and flow and then selectively supplying, or not supplying, coolant to the nozzles or groups of nozzles in strict conformity with those shapemeter signals representative of remaining shape error and in correspondence with particular shapemeter channels or groups of channels. Thus by controlling the coolant flow the thermal profile of the rolls and hence the roll gap may be modified in a non-uniform manner along the roll at least across the width of the strip.

Figure 4:
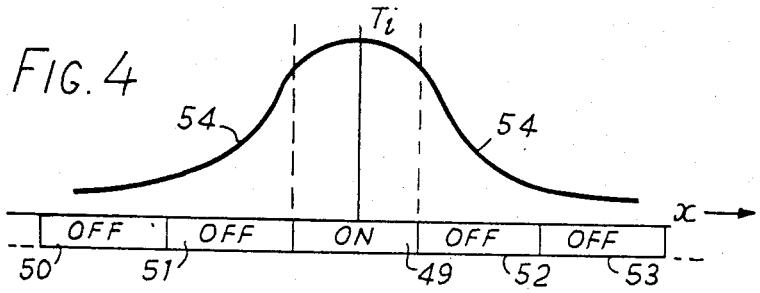

The graph of FIG. 4 shows a thermal influence function Ti plotted against strip width x for a particular nozzle (or group of nozzles) 19 which is dispensing coolant while adjoining nozzles (or groups of nozzles) 50, 51, 52, 53 are shut off. If the coolant being dispensed strikes the rolls/strip over a width corresponding to the width of the spray from the nozzle (or group of nozzles) 49 the effect on the thermal profile of the rolls will be spread as shown by the parts 54 of the curve.

It is therefore possible to determine an influence function dependent upon mill and spray geometry. Thus the decision to supply coolant to a particular zone must be taken by considering not only the shape still to be corrected of that part of the strip within the influence function of spray from a particular nozzle (or group of nozzles) but also the effect of coolant flow through all adjoining nozzles (or groups of nozzles) having overlapping influence functions.

The spray bar controller 48 may be programmed so that the flow from individual nozzles (or groups of nozzles) is varied in such a way as to minimise in a Least Squares sense the distribution E (x)−D (x) where D (x) is formed by adding the effects of the influence functions from individual nozzles (or group of nozzles). Under this procedure the flow of coolant from an individual nozzle (or group of nozzles) will not be varied to correct the shape of that part of the strip corresponding to an individual shapemeter channel (or group of channels) as would be the case with known systems if this would cause either a deterioration in the overall shape distribution or would prove unnecessary because the correction would have been effected by operation of an adjoining nozzle (or group of nozzles).

Although secondary correction by coolant spray has been described it will be understood that the thermal profile of the rolls could also be modified by other heating or cooling means for example by heating one or more rolls in separated zones or by air jet cooling.

Thus the present invention enables more accurate primary control of strip shape to be achieved than has hitherto been possible because both jack and both screw means are adjusted independently. This results in a significant reduction in the remaining errors left for secondary correction and therefore faster control. The extent to which these smaller remaining errors are then minimised by secondary correction is enhanced by the use of the influence function in controlling the thermal profile of the rolls.

Furthermore as mentioned above individual adjustment of each jack means and each screw means may be arranged to change the strip thickness at the centre line (or at any other position) of the strip, whereas if non-interaction between shape control and any separately provided gauge control (not described) is desired this may be achieved by ensuring that the thickness change at the centre line of the strip is zero.

What I claim is:

1. A method of controlling one stand of a mill for rolling strip material, the mill having upper and lower back-up rolls and a pair of work rolls disposed between the back-up rolls, first and second screw means for respectively controlling movement of the ends of one of the back-up rolls and first and second jack means for respectively applying forces to each of the ends of the work rolls and a shape sensor having outputs from which the stress distribution across the width of the rolled strip is determined, comprising determining the effect upon the shape of the strip of the joint operation of the screw means and the joint operation of the jack means and deriving two mathematical expressions, respectively, representative of such operations, determining the difference between said stress distribution and a desired stress distribution and obtaining a correction of stress distribution characterised by separately determining the effect upon the shape of the strip of the operation of each screw means and each jack means and deriving four mathematical expressions each including a control parameter respectively representative of such operations, determining a single error distribution E (x) as the difference between said stress distribution and a desired stress distribution, obtaining a single correction of stress distribution C (x) by determining an optimum value for each of said control parameters such that a function of the distribution E (x)−C (x) is minimized and separately controlling each of said screws and jacks in accordance with said control parameters.

2. A method according to claim 1 in which the distribution C (x) is obtained so that the expression E (x)−C (x) is minimized without affecting strip thickness at some predetermined position across the strip width so as to ensure non-interaction between the shape control and any gauge control mechanism associated with the mill stand.

3. A method according to claim 2 in which the predetermined position is the centre line of the strip.

4. A method according to claim 2 in which C (x) is determined so that the strip thickness at a predetermined position across the strip width is altered.

5. A method according to claim 1 in which the stress distribution left in the strip after applying primary stress correction control to the screws and jacks is further reduced by separately modifying the thermal profile of the rolls in a multiplicity of zones disposed along the roll and respectively corresponding to selected output channels or groups of output channels of the shape sensor the modification in each zone extending over a predetermined area of the rolls comprising calculating an influence factor for each zone depending upon the extent and magnitude of the influence of the modification of each zone on the predetermined areas associated with adjoining zones, effecting said modification of selected zones corresponding with those channels of the shape sensor the output of which represents uncorrected stress in the strip the magnitude and sense of the modification is selected zones being subject to said influence factor to vary the thermal profile of the rolls in the sense to minimize said remaining stress distribution.

6. A method according to claim 5 in which said modification is by coolant sprays and the flow of coolant in each spray zone is varied to minimize in a Least Squares sense the distribution E (x)−D (x) where D (x) is derived by adding the effects of the influence functions from individual zones.

7. A method according to claim 2 in which the stress distribution left in the strip after applying primary stress correction control to the screws and jacks is further reduced by separately modifying the thermal profile of the rolls in a multiplicity of zones disposed along the roll and respectively corresponding to selected output channels or groups of output channels of the shape sensor the modification in each zone extending over a predetermined area of the rolls comprising calculating an influence factor for each zone depending upon the extent and magnitude of the influence of the modification of each zone on the predetermined areas associated with adjoining zones, effecting said modification of selected zones corresponding with those channels of the shape sensor the output of which represents uncorrected stress in the strip the magnitude and sense of the modification in selected zones being subject to said influence factor to vary the thermal profile of the rolls in the sense to minimize said remaining stress distribution.

8. A method according to claim 7 in which said modification is by coolant sprays and the flow of coolant in each spray zone is varied to minimize in a Least Squares sense the distribution E (x)−D (x) where D (x) is derived by adding the effects of the influence functions from individual zones.

9. A method according to claim 3 in which the stress distribution left in the strip after applying primary stress correction control to the screws and jacks is further reduced by separately modifying the thermal profile of the rolls in a multiplicity of zones disposed along the roll and respectively corresponding to selected output channels or groups of output channels of the shape sensor the modification in each zone extending over a predetermined area of the rolls comprising calculating an influence factor for each zone depending upon the extent and magnitude of the influence of the modification of each zone on the predetermined areas associated with adjoining zones, effecting said modification of selected zones corresponding with those channels of the shape sensor the output of which represents uncorrected stress in the strip the magnitude and sense of the modification in selected zones being subject to said influence factor to vary the thermal profile of the rolls in the sense to minimize said remaining stress distribution.

10. A method according to claim 9 in which said modification is by coolant sprays and the flow of coolant in each spray zone is varied to minimize in a Least Squares sense the distribution E (x)−D (x) where D (x) is derived by adding the effects of the influence functions from individual zones.

11. A method according to claim 4 in which the stress distribution left in the strip after applying primary stress correction control to the screws and jacks is further reduced by separately modifying the thermal profile of the rolls in a multiplicity of zones disposed along the roll and respectively corresponding to selected output channels or groups of output channels of the shape sensor the modification in each zone extending over a predetermined area of the rolls comprising calculating an influence factor for each zone depending upon the extent and magnitude of the influence of the modification of each zone on the predetermined areas associated with adjoining zones, effecting said modification of selected zones corresponding with those channels of the shape sensor the output of which represents uncorrected stress in the strip the magnitude and sense of the modification in selected zones being subject to said influence factor to vary the thermal profile of the rolls in the sense to minimize said remaining stress distribution.

12. A method according to claim 11 in which said modification is by coolant sprays and the flow of coolant in each spray zone is varied to minimize in a Least Squares sense the distribution E (x)−D (x) where D (x) is derived by adding the effects of the influence functions from individual zones.

* * * * *